United States Patent [19]

Lamle

[11] Patent Number: 4,743,031

[45] Date of Patent: May 10, 1988

[54] DICE AND TOKEN GAME APPARATUS

[76] Inventor: Stewart M. Lamle, 55 West 86th Street, New York, N.Y. 10024

[21] Appl. No.: 86,733

[22] PCT Filed: Apr. 25, 1986

[86] PCT No.: PCT/US86/00914

§ 371 Date: Feb. 24, 1987

§ 102(e) Date: Feb. 24, 1987

[87] PCT Pub. No.: WO86/06292

PCT.Pub. Date: Nov. 6, 1986

Related U.S. Application Data

[63] Continuation-in-part of Ser. No. 728,701, Apr. 29, 1985, abandoned.

[51] Int. Cl.[4] ..... A63F 9/04

[52] U.S. Cl. ..... 273/146

[58] Field of Search ..... 273/146

[56] References Cited

U.S. PATENT DOCUMENTS 2,560,187 7/1951 Post ..... 273/146

FOREIGN PATENT DOCUMENTS 393917 11/1908 France ..... 273/146
967462 3/1950 France ..... 273/146
1524470 4/1968 France ..... 273/146

OTHER PUBLICATIONS

Scarne, Scarne's encyclopedia of games © 1973 pp. 454–497.

*Primary Examiner*—Paul E. Shapiro

[57] ABSTRACT

A game apparatus for two or more players includes a plurality of dice having various forms of indicia on the sides of the dice, and a plurality of tokens wherein each token has one of the indicia forms used on the dice. One player throws the dice, and the indicia showing on the dice are used to determine if the player receives a token, wins the pot, splits the pot with the house, or splits the pot with another player already holding a token.

7 Claims, 3 Drawing Sheets

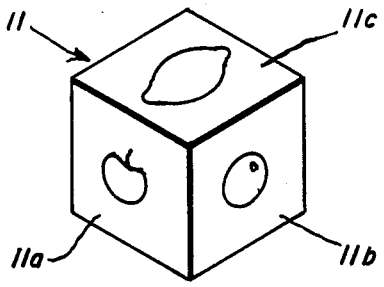
Fig_1A
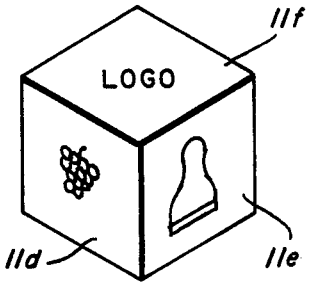
Fig_1B
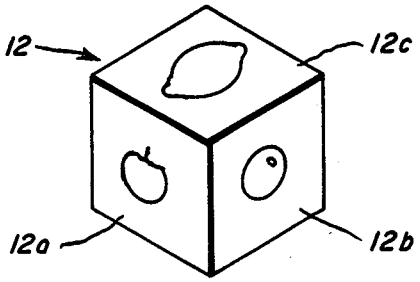
Fig_2A
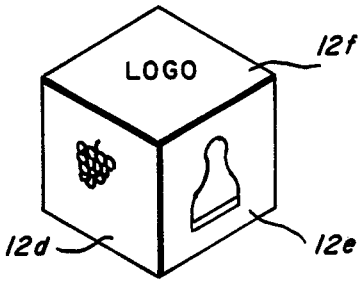
Fig_2B
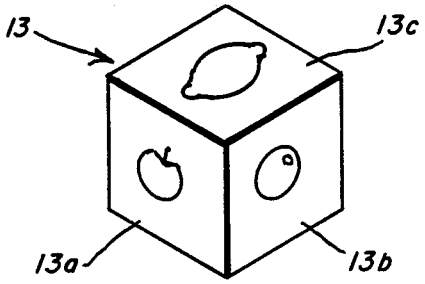
Fig_3A
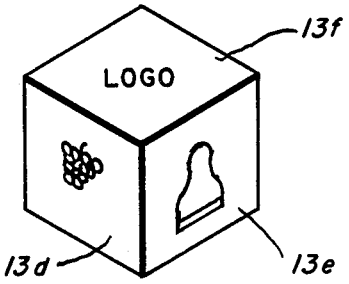
Fig_3B
Fig_4
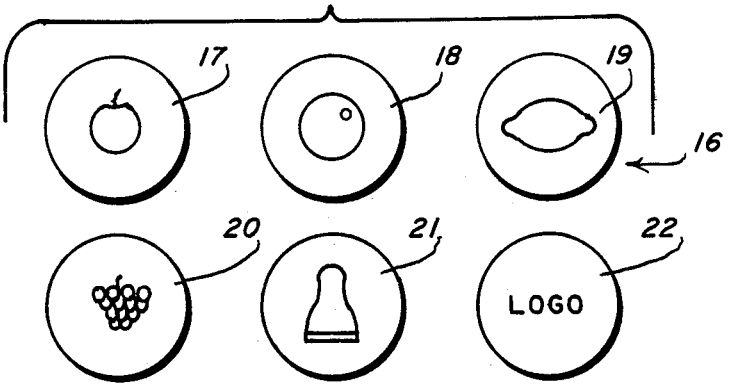

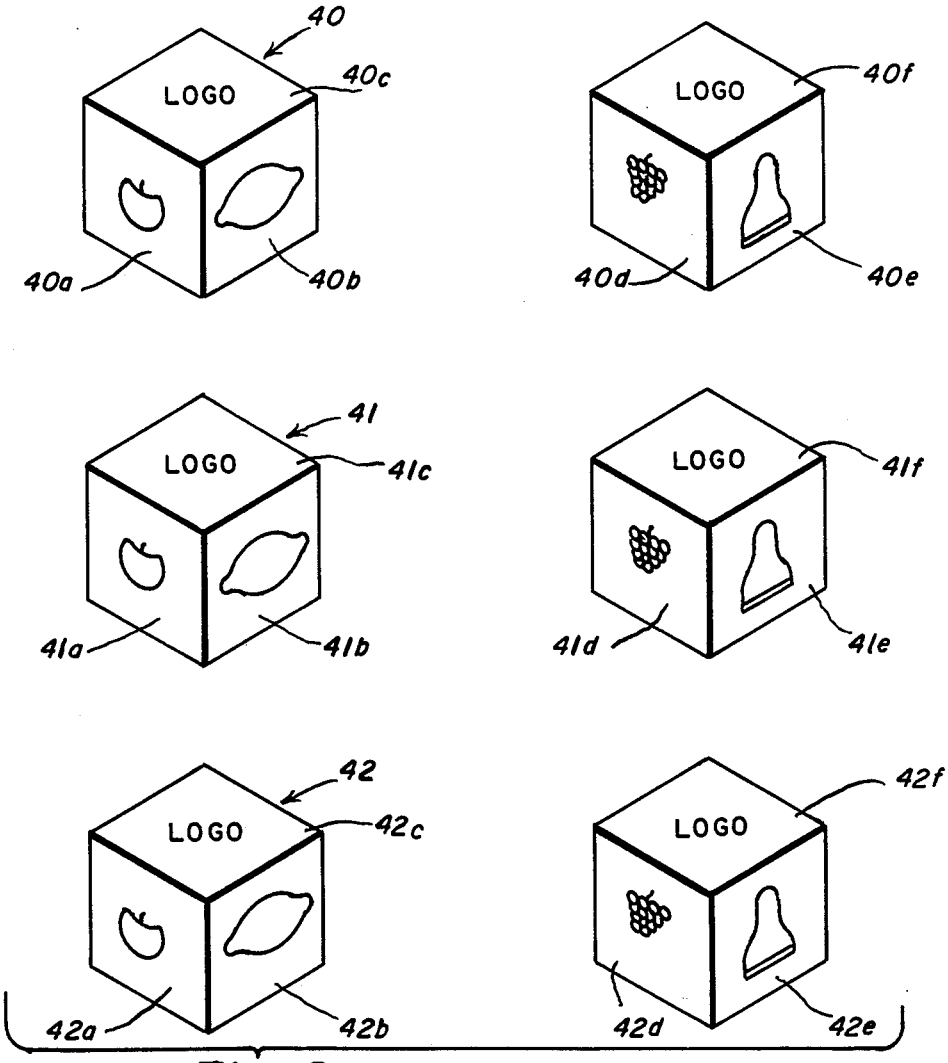
Fig_8
Fig_9
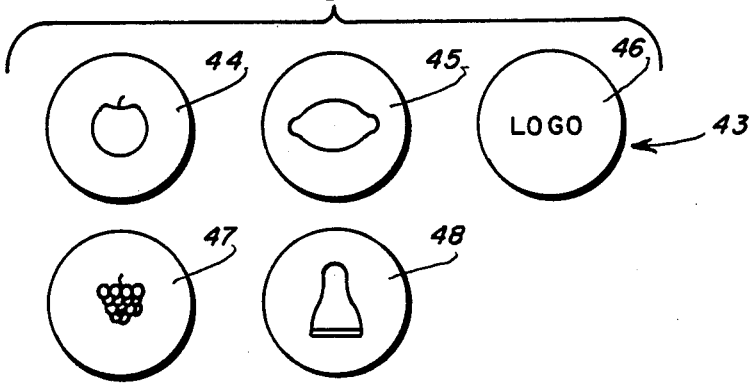

DICE AND TOKEN GAME APPARATUS

This case is a continuation-in-part of U.S. Ser. No 728,701 filed Apr. 29, 1985, now abandoned.

DESCRIPTION

1. Technical Field

The invention relates to a game apparatus comprising a plurality of dice and a plurality of tokens.

2. Background Art

Various games utilizing dice-like playing pieces are well known in the art. The faces of the dice usually include dot patterns representative of various numbers. After a throw of the dice, the numbers are totaled or otherwise used to indicate the outcome of the throw.

It would be desirable to have a game apparatus utilizing dice in which the outcome of the throw is not determined by totaling the numbers showing on the thrown dice.

It is therefore an object of the invention to provide a game apparatus comprising a plurality of dice having indicia thereon and a plurality of tokens having similar indicia.

BRIEF DESCRIPTION OF THE DRAWINGS

FIGS. 1A, 1B, 2A, 2B, 3A, and 3B show a plurality of dice usable with the game apparatus of the invention.

FIG. 4 shows a plurality of tokens usable with the dice shown in FIGS. 1 through 3.

FIGS. 6 through 8 show alternate forms of dice usable in the game of the present invention.

FIG. 9 shows tokens which are usable with the dice of FIG. 8.

BEST MODE FOR CARRYING OUT THE INVENTION

Figure 5:
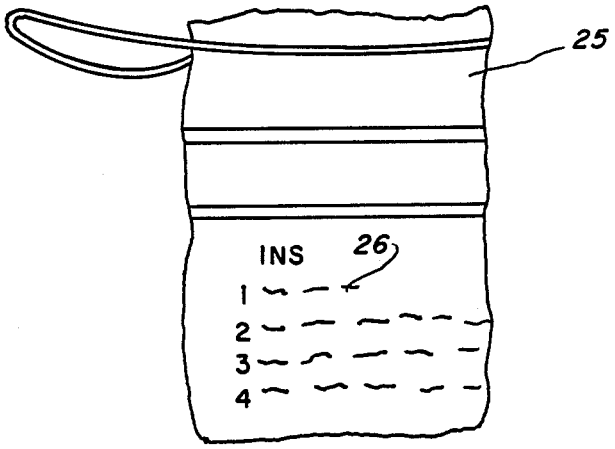
FIG. 5 shows a container for the game apparatus of the invention.

Turning now to the drawing Figures, FIG. 1A shows sides 11*a*, 11*b*, and 11*c* of a die 11,; and FIG. 1B shows sides 11*d*, 11*e*, and 11*f* of die 11. FIG. 2A shows sides 12*a*, 12*b*, and 12*c* of a die 12; and FIG. 2B shows sides 12*d*, 12*e*, and 12*f* of die 12. FIG. 3A shows sides 13*a*, 13*b*, and 13*c* of die 13; and FIG. 3B shows sides 13*d*, 13*e*, and 13*f* of die 13.

Each side of die 11 has indicia thereon which is different than the indicia shown on the the remaining sides of die 11. As an example, side 11*a* may show an apple, side 11*b* an orange, side 11*c* a lemon, side 11*d* grapes, side 11*e* a bell, and side 11*f* a logo. Each of the die 12 and 13 show the same indicia on the corresponding sides thereof. That is, side 12*a* of die 12 shows an apple, 12*b* an orange, 12*c* a lemon, 12*d* grapes, 12*e* a bell, and 12*f* a logo. Likewise, die 13 shows on side 13*a* an apple, 13*b* an orange, 13*c* a lemon, 13*d* grapes, 13*e* a bell, and 13*f* a logo.

FIG. 4 shows a set of tokens 16 used with the dice of the instant invention. The number of tokens in the set 16 is equal to the number of sides on one of the dice; and accordingly, when 6 sided dice are used, 6 tokens comprise the set 16. Each token in the set 16 shows one of the indicia shown on the dice, and no two tokens are alike. Thus, set 16 comprises tokens 17–22 wherein token 17 shows an apple, token 18 shows an orange, token 19 shows a lemon, token 20 shows grapes, token 21 shows a bell, and token 22 shows a logo.

The game apparatus comprising the three dice and the six tokens may be conveniently contained in a receptacle such as the bag 25 shown in FIG. 5. The side of the bag may be imprinted with instructions 26 for playing the game or with other decorative designs as desired.

MODE OF USE OF THE BEST MODE

Two or more players may play the game with three or more players being preferred.

Game play progresses according to the following rules:

1. Before the dice are thrown, each player contributes an ante to form a pot. The amount of the ante is determined by the player throwing the dice.
2. A throw by any player resulting in all three dice showing the same indicia on the upper die face entitles that player to the entire pot. The same player sets a new ante and throws the dice again.
3. A throw by any player resulting in two of the three dice showing the same indicia, entitles that player to take the token having the same indicia, if that token is available. If that token is not available and is already held by another player, the player throwing the dice splits the pot with the player holding that token. The player with the token then returns the token so that it is available to any player who subsequently rolls a pair with the same indicia. If the token is not available and is held by the player who has thrown the dice giving the same indicia a second time, that player splits the pot with himself, i.e. that player takes the whole pot and returns the held token. In either event, the same player sets a new ante and throws the dice again.
4. A throw of the dice resulting in all of the dice showing different indicia on the upper faces requires that player to pass the dice to the next player. The next player sets a new ante and throws the dice.
5. In implementing rules 1 through 4, the logo indicia may be a house indicia; and throughout game play the logo token is "held" by the house. Accordingly, a player rolling the dice resulting in two dice showing the logo splits the pot with the house. A roll of the dice resulting in all three dice showing the logo, however, gives the entire contents of the pot to the player who threw the dice.

Having thus described the apparatus and method of use of the invention, various alterations and modifications will occur to those skilled in the art. For instance, other dice configurations may be used.

Figure 6:
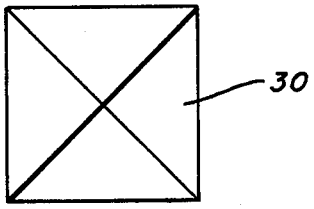

FIG. 6 is an end view of eight-sided dice 30. When using such dice, eight tokens are required, wherein the indicia on each token corresponds to the indicia on one of the faces of the dice 30.

Figure 7:
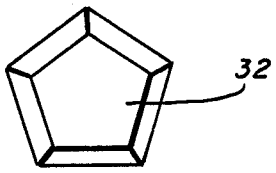

FIG. 7 is an end view of twelve-sided dice 32. When such dice are used, twelve tokens are required, with each token having indicia corresponding to the indicia on one of the faces of the twelve-sided dice 32.

In each of the embodiments shown in FIGS. 6 and 7, the indicia on each face of a die is unique; and one of the set of corresponding tokens shows that same indicia. In each of the embodiments of FIGS. 6 and 7, three dice may be used; and the rules of play are substantially as stated above.

FIG. 8 shows three dice 40, 41, and 42 which may be used with an alternate form of the invention. The die 40 comprises 6 sides 40*a* through 40*f*, wherein two of the sides, 40*c* and 40*f* display the same indicia, and the other sides, 4*a*, 4*b* 4*d*, and 4*e*, display different indicia. As shown, the sides of the die 40 display the following indicia: 40*a*— apple; 40*b*— lemon, 40*c*— logo; 40*d*— grapes, 40*e*— bell; and 44*f*— logo. The dice 41 and 42 are similar in arrangement, each having indicia on sides a through f corresponding to the indicia on the sides a through f of die 40. Thus, sides 41*c* and 41*f* of die 41 and sides 42*c* and 42*f* of die 42 show the logo, while sides 41*a* and 42*a* show an apple, sides 41*b* and 42*b* show grapes, and sides 41*e* and 42*e* show a bell.

FIG. 9 shows a set 43 of tokens usable with the dice 40, 41, and 42 of FIG. 8. The tokens 44 through 48 of the set 43 show indicia corresponding to the indicia shown on each of the dice 41, 42, and 43. Thus token 44 shows an apple, 45 a lemon, 46 the logo, 47 grapes, and 48 a bell.

MODE OF USE OF THE ALTERNATE EMBODIMENT

Game play progresses in a manner which is similar to game play with the preferred embodiment. Accordingly, Rules 1 through 5 indicated above are used to conduct game play.

Briefly stated, a throw of the dice showing three similar indicia renders the player a winner. A throw of the dice showing two similar indicia (but not the logo) allows the player to take the token with the same indicia if it is available, or to split the pot with a player already holding the token with the same indicia.

After the pot is split, the player holding the token returns the token to the table for further game play. In the event that two dice show the logo, the logo token is "held" by the house; and accordingly, the player splits the pot with the house.

Other embodiments of the invention are possible. The dice may be in the shape of any regular polyhedron and may be constructed to have the logo shown on more than one face thereof. In such embodiments, the number of sides on each die may be express as N; and the number of sides of each die having the same indicia thereon may be expressed as X. The number of different indicia used on the dice will be equal to $N-X+1$, and the number of tokens which are used with such dice sets will be equal to $N-X+1$.

The game of the present invention may also taken an electronic form. In such a game, physical tokens do not pass to the players. Instead, an electronically activated indicator shows whether or not a player has a claim on the pot as a result of an indicia pair being rolled, in the event the same indicia pair is rolled again.

Having thus described the invention, various alterations and modifications will be apparent to those skilled in the art, which alterations and modifications are intended to be within the scope of the invention as defined in the appended claims.

I claim:

1. A process of utilizing a game apparatus comprising 3 dice each having 6 sides and 6 tokens, wherein 6 forms of indicia are used on the sides of the dice and no 2 sides of any dice have the same indicia thereon, and wherein each token has a form of indicia thereon which is the same as the indicia used on the dice, the process comprising the steps of:

(1) throwing all 3 dice;

(2) rendering a player a winner if all 3 of the thrown dice show the same indicia;

(3) awarding a player a token if 2 of the thrown dice show the same indicia, wherein the token has the same indicia thereon as on the 2 thrown dice; and (4) rendering a subsequent player a joint winner with the player in (3) above if the subsequent player throws the dice resulting in 2 of the thrown dice showing the same indicia as in (3) above.

2. A process of utilizing a game apparatus comprising 3 dice each having 6 sides and 6 tokens, wherein 6 forms of indicia including 1 house indicia are used on the sides of the dice and no 2 sides of any dice have the same indicia thereon, and wherein each token has a form of indicia thereon which is the same as the indicia used on the dice, the process comprising the steps of:

(1) throwing all 3 dice;

(2) rendering a player a winner if all 3 of the thrown dice show the same indicia;

(3) awarding a player a token if 2 of the thrown dice show the same nonhouse indicia, wherein the token has the same indicia thereon as on the 2 thrown dice;

(4) rendering a subsequent player a joint winner with the player in (3) above if the subsequent player throws the dice resulting in 2 of the thrown dice showing the same indicia as in (3) above; and (5) returning the token of the player in (3) above to the table for further play.

3. The process of claim 2 further comprising the steps of:

(1) awarding a player one half of the winnings if two of the dice thrown by that player show the house indicia; and (2) awarding the other half of the winnings to the house.

4. A process of utilizing a game apparatus comprising three similar regular polyhedron dice each having N sides and N tokens, wherein N forms of indicia are used on the sides of the dice and no two sides of any dice have the same indicia thereon, and wherein each token has a form of indicia thereon which is the same as the indicia used on the dice and no two tokens have the same indicia, the process comprising the steps of:

(1) throwing all three dice;

(2) rendering a player a winner if all three of the thrown dice show the same indicia.

(3) awarding a player a token if two of the thrown dice show the same indicia, wherein the token has the same indicia thereon as on the two thrown dice;

(4) rendering a subsequent player a joint winner with the player in (3) above if the subsequent player throws the dice resulting in two of the thrown dice showing the same indicia as in (3) above; and (5) returning the token awarded in step 3 to the game for one half of the winnings.

5. A process of utilizing a game apparatus comprising three similar regular polyhedron dice each having N sides and N tokens, wherein N forms of indicia including one house indicia are used on the sides of the dice and no two sides of any dice have the same indicia thereon, and wherein each token has a form of indicia thereon which is the same as the indicia used on the dice and no two tokens have the same indicia, the process comprising the steps of:

(1) throwing all three dice;

(2) rendering a player a winner if all three of the thrown dice show the same indicia;

(3) awarding a player a token if two of the thrown dice show the same nonhouse indicia, wherein the token has the same indicia thereon as on the two thrown dice;

(4) rendering a subsequent player a joint winner with the player in (3) above if the subsequent player throws the dice resulting in two of the thrown dice showing the same indicia as in (3) above; and (5) returning the token awarded in step 3 to the game for one half of the winnings.

6. The process of claim 5 further comprising the steps of:

(1) awarding a player one half of the winnings if two of the dice thrown by that player show the house indicia; and (2) awarding the other half of the winnings to the house.

7. A process of utilizing a game apparatus comprising three similar regular polyhedron dice each having N faces and a plurality of tokens, wherein X is equal to the number of sides on each die which have the same house indicia thereon, wherein N-X+1 forms of indicia are used; and the number of tokens equals N-X+1, the process comprising the steps of:

(1) throwing all three dice;

(2) rendering a player a winner if all three of the thrown dice show the same indicia;

(3) awarding a player a token if two of the thrown dice show the same nonhouse indicia, wherein the token has the same indicia thereon as on the two thrown dice;

(4) rendering a subsequent player a joint winner with the player in (3) above if the subsequent player throws the dice resulting in two of the thrown dice showing the same indicia as in (3) above;

(5) returning the token awarded in step 3 to the game for one half of the winnings;

(6) awarding a player one half of the winnings if two of the dice thrown by that player show the house indicia; and (7) in conjunction with step (6), awarding the other half of the winnings to the house.

* * * * *